United States Patent [19]

Humphrey

[11] 4,299,076

[45] Nov. 10, 1981

[54] WRAPPING APPARATUS AND METHOD

[75] Inventor: John R. Humphrey, Naples, Fla.

[73] Assignee: International Packaging Machines, Inc., Naples, Fla.

[21] Appl. No.: 72,471

[22] Filed: Sep. 4, 1979

[51] Int. Cl.[3] ..... B65B 11/04

[52] U.S. Cl. ..... 53/587; 53/211; 269/54.1; 198/344

[58] Field of Search ..... 53/211, 556, 587; 242/83; 198/344; 269/54.1, 54.2, 54.3, 54.4, 54.5; 414/65, 66; 104/35

[56] References Cited

U.S. PATENT DOCUMENTS

| | | | |
|---|---|---|---|
| 1,026,721 | 5/1912 | Thomas | 269/54.3 |
| 1,388,408 | 8/1921 | Crosbie | 269/54.1 |
| 1,949,262 | 2/1934 | Stromelly | 269/54.5 |
| 2,954,180 | 9/1960 | Crum | 242/83 |
| 3,626,654 | 12/1971 | Hoffler et al. | 53/442 |
| 3,888,341 | 6/1975 | Konkal | 198/345 |
| 4,077,179 | 3/1978 | Lancaster | 53/211 |

*Primary Examiner*—John Sipos

*Attorney, Agent, or Firm*—LeBlanc, Nolan, Shur & Nies

[57] ABSTRACT

Successive layers of stretch film are wrapped around a load stacked on a motor driven rotatable turntable, the film being supplied as the leading end of a web pulled off a rotatable non-driven roll, and rotation of the roll being initially positively restricted by a spring biased brake. Tension in the web is successively increased to automatically increase stretch in the web in stages during succeeding revolutions. An anchoring member is automatically projected to hold the pallet immovable on the table during wrapping.

7 Claims, 11 Drawing Figures

WRAPPING APPARATUS AND METHOD

This invention relates to apparatus and methods for wrapping relatively large pallet mounted loads with stretchable sheet plastic material as for enabling safe transport of the load between a pallet loading station and a station where the load is unwrapped for use and is particularly concerned with such apparatus and methods wherein there is provided specially controlled tension of a web of the plastic material being pulled off a supply roll and special arrangements are provided for anchoring a pallet on a turntable during wrapping.

In its preferred embodiment the invention will be disclosed as applied to the wrapping of a sensitive load consisting of a relatively large number of cans, such as aerosol, soft drink or beer cans, stacked on a pallet. Such loads when unsupported are unstable and pecularily sensitive to external forces that may topple the stack, and the novel aspects of the invention are especially adapted to controllably wrap such unstable sensitive loads.

Heretofore pallet loads of this general type have been proposed to be wrapped using heat shrinkable film or tensioned stretch film, and the present invention is primarily concerned with stretch wrapping.

Burhop et al U.S. Pat. No. 3,495,375 disclosed an apparatus and method whereby the leading end of a web of thin polyethylene film is drawn off a vertical axis supply roll rotating substantially unrestricted about its vertical axis until the load is completely surrounded by a relatively loose layer of the film, and that layer is anchored to the load at the leading end and tensioned to provide a tight wrapper about the load as by reversing the direction of rotation of the roll for exerting a positive pull on the film. The trailing portion of the web is clamped and secured as by heat sealing to the layer of film tensioned around the load and substantially simultaneously severed. When the web is severed a new leading end is available for starting wrapping of the succeeding load.

Lancaster et al U.S. Pat. Nos. 3,867,806 and 4,050,221 disclose apparatus and methods of wrapping wherein an initial layer of stretchable thin polyethylene film is drawn off a freely rotatable supply roll and relatively loosely wrapped about a load on a motor driven turntable mounted pallet and then the film is tensioned and stretched as by braking rotation of the supply roll while a subsequent layer of the film is wrapped over the first layer. A further Lancaster et al U.S. Pat. No. 4,077,179 discloses tensioned wrapping of a turntable mounted load using clamps on the turntable for the leading edge of the web being drawn from the supply roll which is being braked, and simultaneous clamping and severing of the tensioned web at the trailing part of the wrapped section so that a new leading edge is provided in position to begin wrapping of a following load.

The present invention constitutes an improvement over the apparatus and methods disclosed in the above-identified patents.

It is a major object of the invention to provide a system and method for wrapping a sensitive load on a motor driven turntable with stretchable sheet plastic material wherein a plurality of layers of said material are controllably wrapped about the load by a web drawn off a rotatable supply roll, with rotation of the roll undergoing initial restriction and successive stages of increasing restriction to impart successive increasing stages of tension and resultant stretch in the film as each successive layer is wrapped about the load.

Pursuant to this object the supply roll is subjected to initial restriction of its rotation by spring biased brake means, and further restriction is imposed by electromagnetic brake means.

Another major object of the invention is to provide a novel arrangement for holding a pallet mounted load on a rotating turntable while stretch film is being pulled off a supply roll and wrapped about the load.

Pursuant to this object the holding arrangement may comprise an automatic or manually actuatable structure on the turntable operable for positively engaging and holding the pallet against movement relative to the turntable.

A further object of the invention is to provide a novel cam operated pallet anchoring mechanism.

A further object of the invention is to provide a novel control system and method for the wrapping of stretchable plastic film about a load on a power driven turntable wherein successive timed increases in tension are imposed on the film as it is drawn from a supply roll.

Another object of the invention is to provide a novel load supporting roller surfaced turntable that may be an intermediate section of a roller conveyor characterized by manually or cam actuated means for displacing an anchoring member up through spaces between at least two adjacent rollers to seizably engage a pallet supported by the roller.

Further novel features and other objects of this invention will become apparent from the following detailed description, discussion and the appended claims taken in conjunction with the accompanying drawings.

PREFERRED EMBODIMENTS

Figure 1:
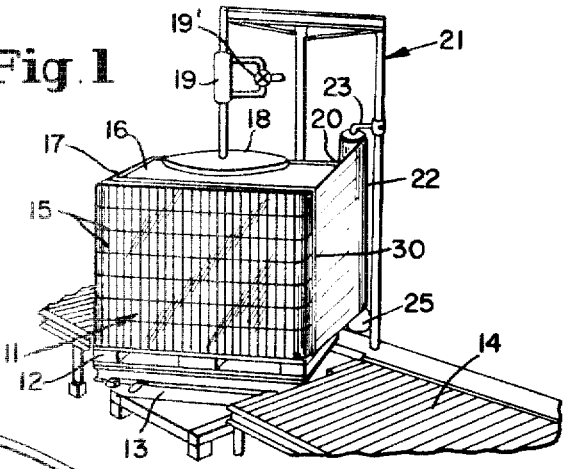
FIG. 1 is a generally perspective view showing the invention according to a preferred embodiment.

Referring to FIG. 1 a load 11 of empty cans is mounted on a wooden pallet 12 which is shown located on a rotatable turntable 13 that comprises a section of a roller conveyor indicated at 14. In FIG. 1 the turntable which carries a series of transverse pallet support rollers like the rest of the conveyor is shown as slightly rotated about its vertical axis to better explain the nature of the invention, but it will be understood that in the starting condition for wrapping the turntable will be in alignment with the rest of the conveyor with its rollers parallel to the other conveyor rollers. In practice the pallet with its load is deposited upon and moved along the right section of the conveyor onto the aligned turntable and, after the wrapping operation to be described, is moved off the turntable onto the left takeaway section of the conveyor.

The cans are vertically stacked in a number of horizontal rows, nine being shown, and a slip sheet 15 of thin synthetic plastic such as PVC is disposed between each row. Another slip sheet 16 covers the top row, and an open rectangular frame 17 of wood or the like overlies the top sheet 16 all around the outer perimeter of the top can row. In the embodiment illustrated a top platen 18 is carried by a pneumatic cylinder assembly 19 which is adapted to raise the platen or urge the platen tightly against the top of the load. A pneumatic control circuit for cylinder 19 contains a solenoid valve 19'.

The can load is embraced by a plurality of metal holding straps 30 that have their opposite ends secured to the pallet and pass over the frame 17 at the top of the load. Usually two parallel straps, one shown in FIG. 1, are used.

Figure 10:
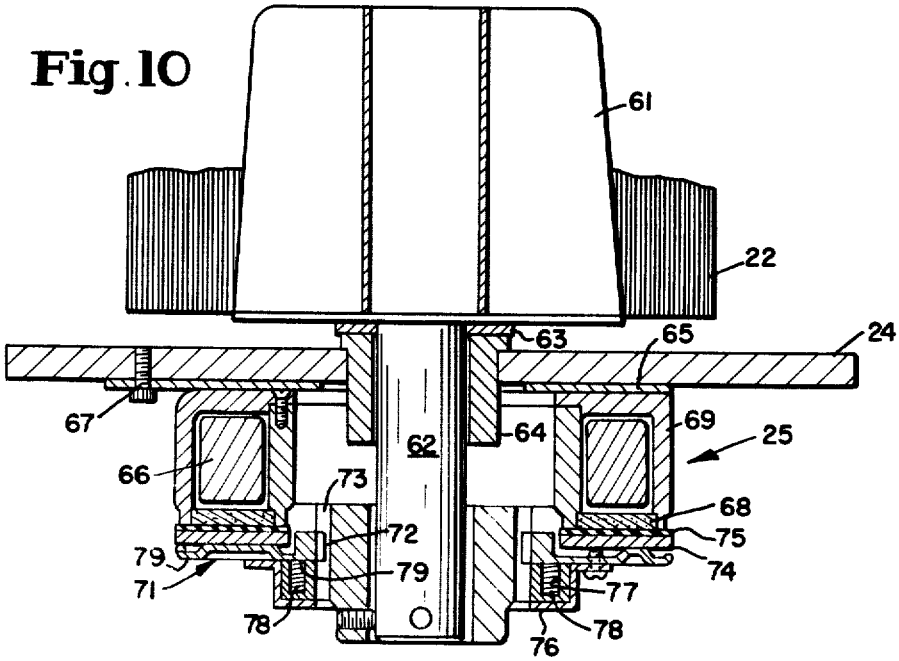
FIG. 10 is a partially sectioned view showing the support and braking arrangement at the lower end of the reel of plastic web.

A suitable support 21 adjacent the conveyor mounts a vertical axis supply roll 22 of transparent clear synthetic plastic web 20 that is to wrap the load. The web 20 may be any conventional stretch film and may for example be the thin polyethylene film disclosed in Lancaster et al U.S. Pat. No. 4,050,221. The roll is rotatably mounted between a top support member 23 (FIG. 1) and a bottom support member 24 (FIG. 10), and as will appear a braking unit 25 indicated in FIG. 1 and shown in detail in FIG. 10 is disposed at the lower end of the roll.

FIG. 1 depicts conditions at the start of a load wrapping operation. The web 20 here has a vertical dimension about equal to the height of the load. The leading end of the web 20 is tucked between a holding strap 30 and the load, and then the turntable is rotated to move that end of the web away from the roll, the web unreeling under the pull exerted by the rotating turntable.

Figure 2:
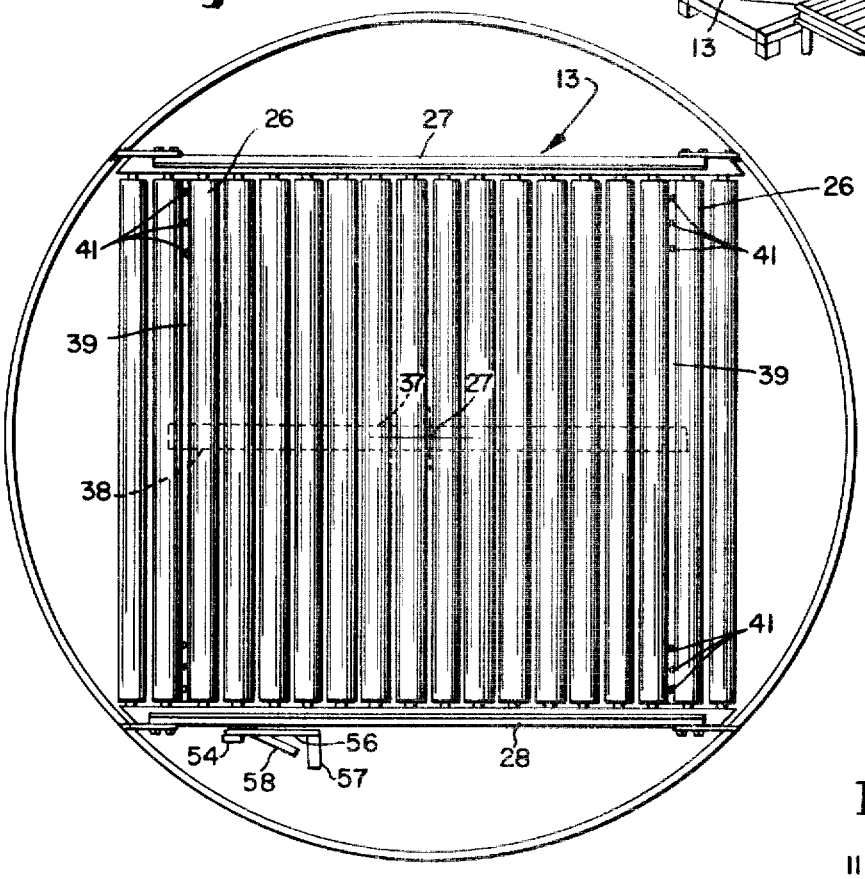
FIG. 2 is a plan view of the pallet mounting turntable showing the pallet anchoring member and some controls.

FIG. 2 shows the turntable 13 with its parallel rows of slightly spaced equal size smooth surfaced cylindrical pallet support rollers 26 that have their ends journalled in the turntable sides 27 and 28 to freely rotate on parallel axes. The wooden bottom of pallet 12 is shown resting on the rollers in FIG. 3.

Figure 3:
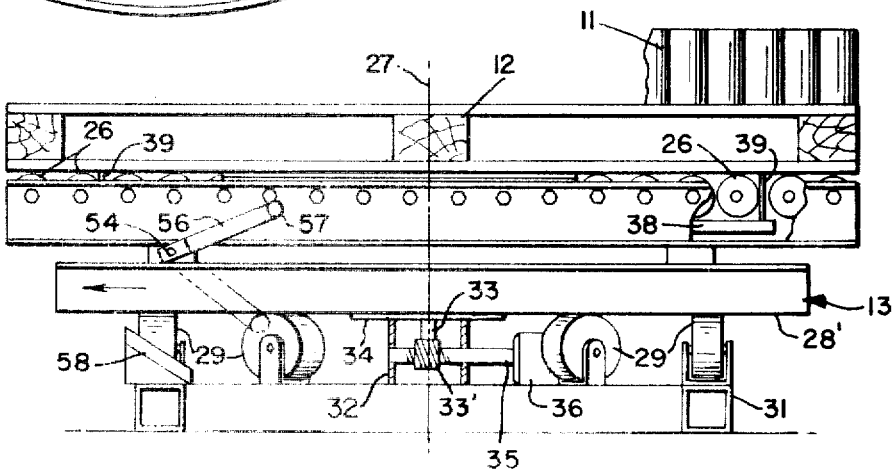
FIG. 3 is a partly diagrammatic side elevation showing the turntable drive and some controls.

The turntable is conventionally mounted for rotation about a central vertical axis indicated at 27 in FIG. 2 and line 27—27 in FIG. 3. As shown the turntable has a flat horizontal surface 28' resting on a circular row of rotatable wheels 29 on a rigid bottom support 31. Support 31 has a central post structure 32 wherein a journalled a shaft 33 coupled by a plate 34 to the bottom of the turntable. Shaft 33 is provided with a geared connection 33' to the output shaft 35 of a turntable drive motor and reduction gear unit 36 mounted on support 31. Any suitable equivalent structure for mounting the turntable for rotation on a vertical axis may be provided.

An important feature of the invention is the provision of an arrangement for locking the loaded pallet against displacement on the turntable during the wrapping operation.

Figure 4:
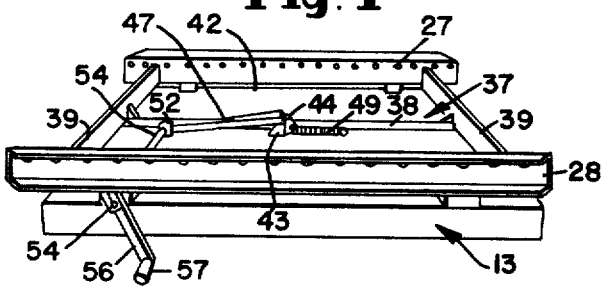
FIG. 4 is a photographic view of the turntable with the rollers removed to show the pallet anchoring member in detail.
Figure 7:
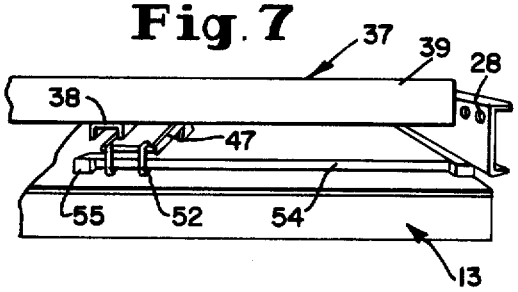
FIG. 7 is a fragmentary end elevation showing further detail of the actuating arrangement for the pallet anchoring member.
Figure 8:
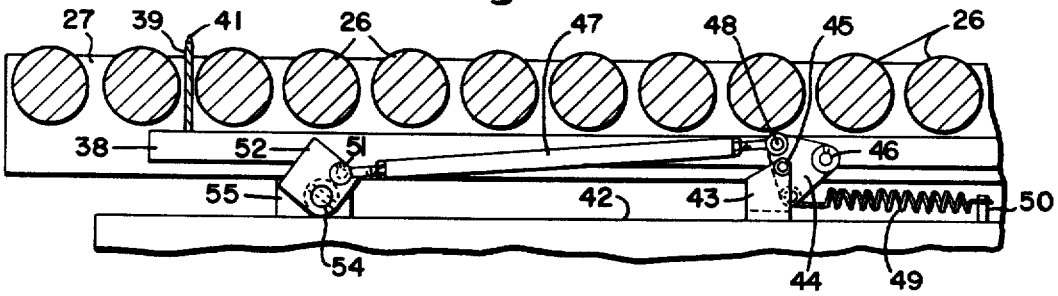
FIGS. 8 and 9 are enlarged fragmentary side elevation and plan views of the overcenter spring biased arrangement.
Figure 9:
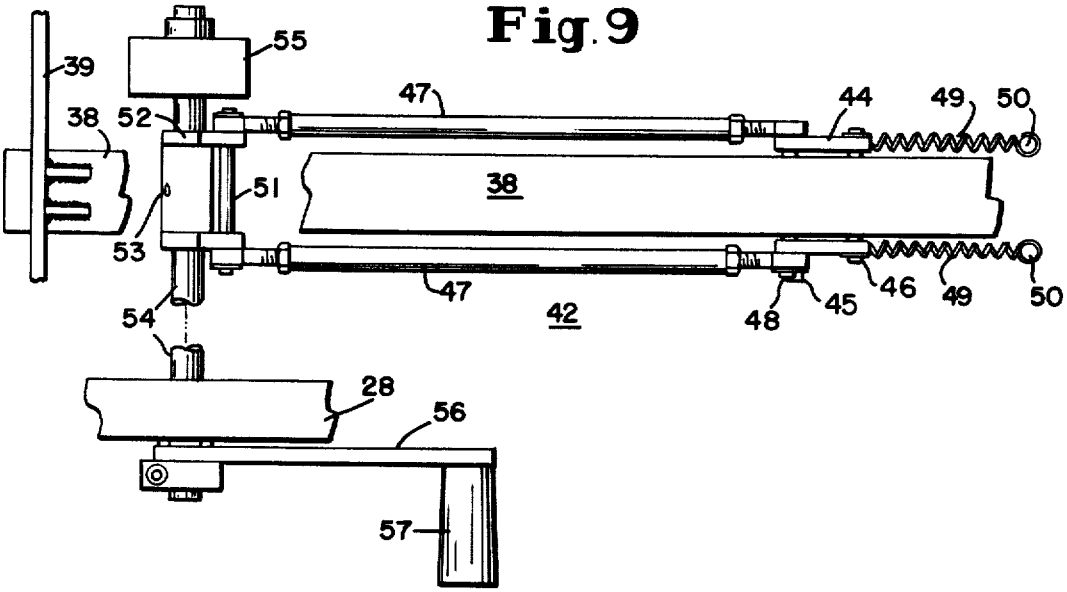
Figure 11:
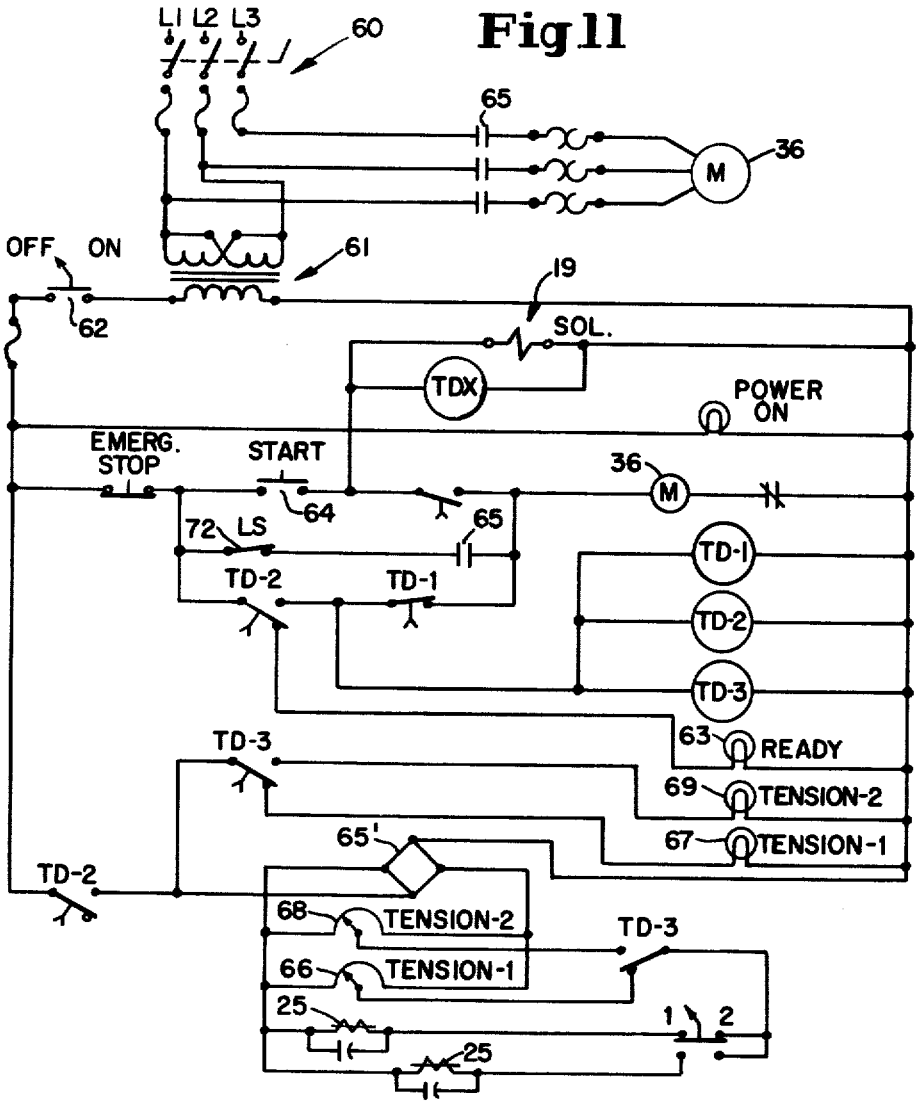
FIG. 11 is a schematic control circuit.

This comprises the provision of a pallet anchoring member 37 which as shown in FIGS. 4 and 8 may be a central longitudinal bar 38 that extends at right angles to rollers 26 and carries at opposite ends two perpendicular transverse bars 39 that are parallel to the rollers 26 and extend upwardly through the spaces between two adjacent rollers. The parallel bars 39 are spaced from each other a distance such that they will underlie the leading and trailing ends of the pallet 12, and they are of a length about equal to the pallet 12.

At the opposite ends of each of the bars 39 a series of sharp pointed pins 41 project vertically upward. These pins, when the anchoring member 37 is raised to its upper position as will be later described in more detail, project above the horizontal plane of the top surfaces of rollers 26 to lockingly penetrate the bottom of pallet 12. This upper position is shown in FIGS. 3 and 8. It will be noted that bars 39 are thin enough to pass freely through the space between the adjacent rollers 26.

FIG. 4 shows the turntable apart from its rotatable support and with rollers 26 removed to better illustrate the pallet anchoring arrangement and structure. The anchoring member 37 is shown in its lower non-anchoring position in FIG. 4 and in its upper pallet anchoring position in FIG. 8. The turntable has a flat horizontal wall 42 extending between side walls 27 and 28 below the level of rollers 26. Centrally, as shown in FIG. 8, a pair of posts 43 upstand rigidly from wall 42, and parallel triangular links 44 are pivotally mounted on the respective posts at 45. The central part of bar 38 is freely pivoted on links 44 by a pivot element 46 at one corner of the links. At another corner of the links 44 parallel rods 47 are pivotally connected at 48. At the other corner of links 44 are connected the ends of parallel tension springs 49 which have their other ends fixed to the wall 42 at 50.

At their other ends rods 47 are pivotally mounted by pivot element 51 upon the arms of a bifurcated member 52 that is fixed by pin 53 on a transverse rock shaft 54 pivotally mounted at opposite ends in side wall 28 and a bracket 55 fixed on wall 42.

All of pivots 45, 46, 48 and 51 and rock shaft 54 have axes parallel to rollers 26 and perpendicular to a plane containing the axis of rotation of the turntable.

Rock shaft 54 projects through side wall 28 and on its end is attached a crank 56 mounting a cam follower 57 adapted to engage an inclined cam 58 on support 31 when rotation of the turntable is started.

Figure 5:
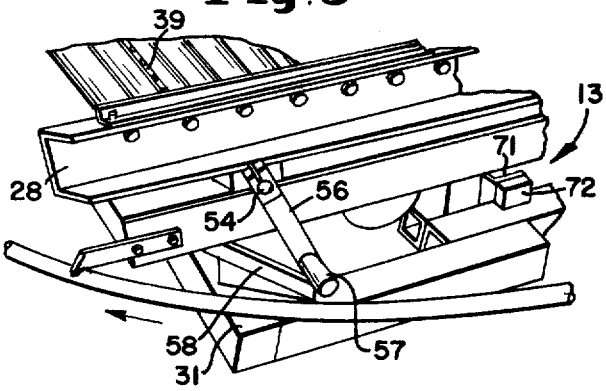
FIGS. 5 and 6 are enlarged photographic fragmentary views showing respectively the two operative positions of the cam operated actuating arrangement for raising and lowering the pallet anchoring member.
Figure 6:
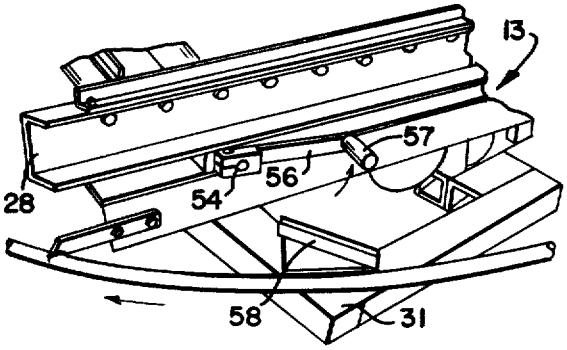

FIG. 5 shows the relationship of crank 56 and cam 58 just as the turntable starts to rotate (from right to left in FIG. 5). The crank is disposed angularly downwardly and follower 57 is at the level of cam 58. After rotation of the turntable starts the follower 57 engages and moves up the incline of cam 58 thereby rocking crank 56 counterclockwise and pulling rods 47 to the left in FIG. 8 to rock links 44 counterclockwise, and when pivot 48 passes over the link pivot 45 the springs 49 take over with a snap action and to move crank 56 to the FIG. 6 position and quickly rock the links 44 to the position shown in FIG. 8 thereby automatically raising the anchoring member to project pins 41 above the plane of rollers 26 and into penetrating engagement with the wooden pallet.

This pallet anchored condition is maintained during the wrapping process and until the operator manually rocks the crank down to the FIG. 5 position. The operator may manually rock the crank 56 to either project or retract the anchor.

FIG. 10 shows the lower chuck 61 on which roll 22 is mounted. A shaft 62 depends from the chuck and is mounted by a thrust bearing 63 and bushing 64 on fixed support 24. Below the support a plate 65 carrying the coil 66 electromagnetic brake 25 is secured as by screws 67. An annular braking surface 68 is secured on the bottom of the housing 69 of the coil.

A brake shoe unit 71 is internally splined at 72 for mounting on splines 73 of shaft 62. Thus the brake shoe unit 71 rotates with shaft 62 and is longitudinally slidable on shaft 62.

A housing 76 is secured as by welding upon the lower end of shaft 62, and this housing is formed with a circular series of upwardly open pockets 77 each housing a small coil spring 78 engaging the flat underside 79 of the brake shoe unit. In the assembly with no power supplied to coil 66, springs 78 which act to exert a uniform upward pressure on the brake shoe unit 71 urge the braking surfaces 75 and 68 into light but effective braking contact whereby to provide an initial positive control drag on roll 22 during the first revolution of the turntable as will appear.

In operation the leading end of the film web is pulled away from the roll and attached to the load 11 as by tucking it under a strap 30. At this time the turntable is aligned with the rest of the roller conveyor and the platen 18 is in inoperative raised position above the load.

Line switch 60 is closed to energize the turntable motor circuit, and transformer 61 supplies power for the control circuit.

Switch 62 is closed by the operator and the ready lamp signal 63 indicates that the control circuit is energized. Starter switch 64 is closed manually. This operates the solenoid valve 19 in the pneumatic circuit to lower the top platen 18 onto the load on the pallet. This also energizes the timer TDX. The operator holds the starter switch closed until the platen has time to descend (1½–2 seconds) and at that time contacts in TDX close to energize the motor starter 65 and the turntable starts to rotate. This also supplies current through closed contacts in timer TD1 to effectively activate the timers TD1, TD2 and TD3.

The turntable rotates at a speed of about nine or six revolutions per minute, and as the turntable rotates film 20 wraps around the sides of load 11. Because of the initial braking action of brake 25 the film will always be under controlled longitudinal tension and will be moving at controlled speed. This not only insures that the web will not droop between the roll 22 and the load but it ensures that there will be no objectionable overrun of web due to tendency of the roll 22 to gain momentum once it starts rotating. For sensitive loads like stacked cans the initial tension must be reasonably low to avoid disturbing the stacked assembly.

The pulling force required to pull the web off the roll must of course be sufficient to overcome the initial inertia of the roll but also the positive rotation restricting braking action of the brake 25, and such is advantageous in that a small but definite longitudinal stretch is imparted to the film from substantially the beginning of the wrapping operation whereby the load is more securely enclosed.

After a little more than one revolution of the turntable (10 seconds) contacts in timer TD2 close and current is supplied through the rectifier 65 and adjustable resistance 66 to actuate the electromagnetic brake 25 and apply an increased but still light tension drag to the rotating web reel. At this point the web being wound on the load undergoes increased stretch, and the signal lamp 67 lights to signal this condition.

After completion of another turntable revolution contacts in timer TD3 close and current from rectifier 65 passes through adjustable resistance 68 to further actuate electromagnetic brake 25 which acts to more strongly apply drag to the rotating web reel thereby placing the web under predetermined full tension and imparting increased stretch for the ensuing revolution so that the load is very tightly wrapped and the lamp 67 is extinguished The resistances 66 and 68 may adjusted to preset the required tension on the film during the respective operational stages.

After the third revolution the timer TD1, which has maintained closed contacts, opens the circuit whereby the current for the turntable motor now passes only through the closed limit switch 72 and the motor starter. When the rotating turntable completes its third revolution a cam 71 on it (FIG. 5) actuates and opens microswitch 72 to deenergize the motor circuit by locking out the motor starter and applying a suitable brake, so that the turntable may coast to a stop in a predetermined position usually oriented in a particular position as for entry by a forklift or for alignment with infeed and/or discharge conveyors. Opening of the switch 72 also opens the circuit to timer TDX and the solenoid valve 19 whereby the platen 18 is automatically retracted.

The web is severed after final layer is wrapped on the load and the trailing end attached conventionally to outer wrapped layer as by static cling, adhesive or heat.

It is within the scope of the invention to accomplish the wrapping of loads on a pallet in two successive steps in the first of which the web would be pulled off the roll under a tension that is more than half the eventual full tension applied to the web, and then after at least one complete wrap the tension is increased to full tension on the web. After subsequent wrap or wraps the web is severed from the roll and the trailing end attached as described above.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. An apparatus for wrapping a stabilizing overwrap about a load mounted on a pallet disposed on a rotatable motor driven turntable, said turntable having substantially horizontal support surface means upon which said pallet is adapted to be directly mounted, a supply roll of overwrap material in web form, means supporting said roll for rotation about an axis substantially parallel to the turntable axis, said roll being located adjacent the turntable whereby the leading end of the web may be made fast relative to the load so that the web may be unrolled and disposed around the load during rotation of the turntable, and anchoring means on said turntable for positively engaging and holding said pallet against movement relative to the turntable as the load is being wrapped, said anchoring means comprising pallet engaging means movably mounted on the turntable for displacement between an idle position below said support surface means while the pallet is being placed on the turntable and a pallet locking position at or above said support surface in anchoring engagement with the underside of a pallet on said support surface means, and means for actuating said anchoring means for displacing said pallet engaging means between said positions, said actuating means comprising relatively stationary means mounted adjacent the turntable, and means on the turntable operably associated with said anchoring means adapted to engage said stationary means during rotation of the turntable and automatically actuate said anchoring means to lock the pallet to the turntable.

2. In the apparatus defined in claim 1, said stationary means comprising cam means.

3. In the apparatus defined in claim 1, said turntable having a series of spaced parallel rollers defining said support surface means on which said pallet is supported, and said pallet engaging means comprises a member that is displaceable between said positions through the space between two adjacent rollers into positive locking engagement with the pallet.

4. In the apparatus defined in claim 3, said member comprising a bar extending parallel to said rollers and having pallet gripping means on its upper portion, and means mounting said bar for movement between an idle lower position below a plane containing the pallet supporting surfaces of said rollers and an upper pallet locking position wherein said pallet gripping means is above said plane.

5. In the apparatus defined in claim 4, said pallet comprising a wooden or like bottom member, and said pallet gripping means on the bar comprising pins adapted to penetrate said pallet bottom member in said upper position.

6. In the apparatus defined in claim 3, said anchoring means comprising a first bar extending at right angles beneath said rollers and said pallet engaging means comprising at each end of said first bar a transverse bar that is parallel to and disposed in accord with the spaces between two adjacent rollers, and means mounting said first bar for displacement toward and from the rollers whereby to project and retract said transverse bars in the spaces between said rollers upon operation of said actuating means.

7. An apparatus for wrapping a stabilizing overwrap about a load mounted on a pallet disposed on a rotatable motor driven turntable having a series of spaced parallel rollers on which said pallet is directly supported, a supply roll of overwrap material in web form, means supporting said roll for rotation about an axis substantially parallel to the turntable axis, said roll being located adjacent the turntable whereby the leading end of the web may be made fast relative to the load so that the web may be unrolled and disposed around the load during rotation of the turntable, and anchoring means on said turntable for positively engaging and holding said pallet against movement relative to the turntable as the load is being wrapped, said anchoring means comprising a longitudinally extending bar extending beneath said rollers and there being at each end of said longitudinally extending bar a transverse bar that is parallel to and disposed to move in the spaces between two adjacent rollers, pallet locking means on said transverse bars, means mounting said longitudinally extending bar for displacement toward and from the rollers whereby to project and retract said transverse bars in the spaces between said rollers to respectively lock and release said pallet relative to said turntable, and actuating means for displacing said longitudinally extending bar comprising link means pivoted on said turntable, means pivoting said longitudinally extending bar intermediate its ends on said link means, crank means rockably mounted on said turntable and having an operating handle at the side of the turntable, rod means pivotably connected between said link means and said crank means, and tension spring means connected between said link means and said turntable.

* * * * *